US006425434B1

(12) United States Patent
Müller

(10) Patent No.: US 6,425,434 B1
(45) Date of Patent: Jul. 30, 2002

(54) CASTING CHAMBER FOR A DIE CASTING MACHINE

(76) Inventor: André Müller, Warpelstrasse 10, CH-3186 Düdingen (CH)

( * ) Notice: Subject to any disclaimer, the term of this patent is extended or adjusted under 35 U.S.C. 154(b) by 0 days.

(21) Appl. No.: 09/585,959

(22) Filed: Jun. 2, 2000

(30) Foreign Application Priority Data

Jun. 4, 1999 (EP) ..... 99810489

(51) Int. Cl.[7] ..... B22D 17/04; B29C 45/03
(52) U.S. Cl. ..... 164/312; 425/544
(58) Field of Search ..... 164/312, 113; 425/544, 192 R

(56) References Cited

U.S. PATENT DOCUMENTS

| | | | | |
|---|---|---|---|---|
| 3,664,411 A | * | 5/1972 | Carver et al. | 164/312 |
| 4,623,015 A | | 11/1986 | Zecman | |
| 4,664,173 A | * | 5/1987 | Wolniak | 164/312 |
| 5,010,946 A | * | 4/1991 | Nogami et al. | 164/312 |
| 5,322,111 A | * | 6/1994 | Hansma | 164/312 |

FOREIGN PATENT DOCUMENTS

| | | | |
|---|---|---|---|
| DE | 2051760 A | | 5/1971 |
| DE | 4229338 A | | 3/1994 |
| DE | 19544716 A | | 5/1997 |
| JP | 01-104453 | * | 4/1989 |
| JP | 40-5038563 A | * | 2/1993 |
| JP | 40-5050204 A | * | 3/1993 |
| SU | 001774900 A3 | * | 11/1992 |

OTHER PUBLICATIONS

Patent Abstracts of Japan (JP–01104453) Apr. 21, 1989.

* cited by examiner

*Primary Examiner*—M. Alexandra Elve
*Assistant Examiner*—Len Tran
(74) *Attorney, Agent, or Firm*—Renner, Kenner, Greive, Bobak, Taylor & Weber

(57) ABSTRACT

The casting chamber for a die casting machine includes a casting chamber jacket in which, over its entire length, there is provided an inner jacket defining the sliding surface for the pressure piston. In order for excessive heat in the inner jacket to be uniformly distributed and passed to the casting chamber jacket, copper rings are inserted in the inner jacket (3), the latter being pressed against the casting chamber jacket by means of screws threaded into a conical wedge. In this manner, heat distortion of the casting chamber can, for the first time, be held within limits, without requiring an oil or water cooling apparatus.

6 Claims, 1 Drawing Sheet

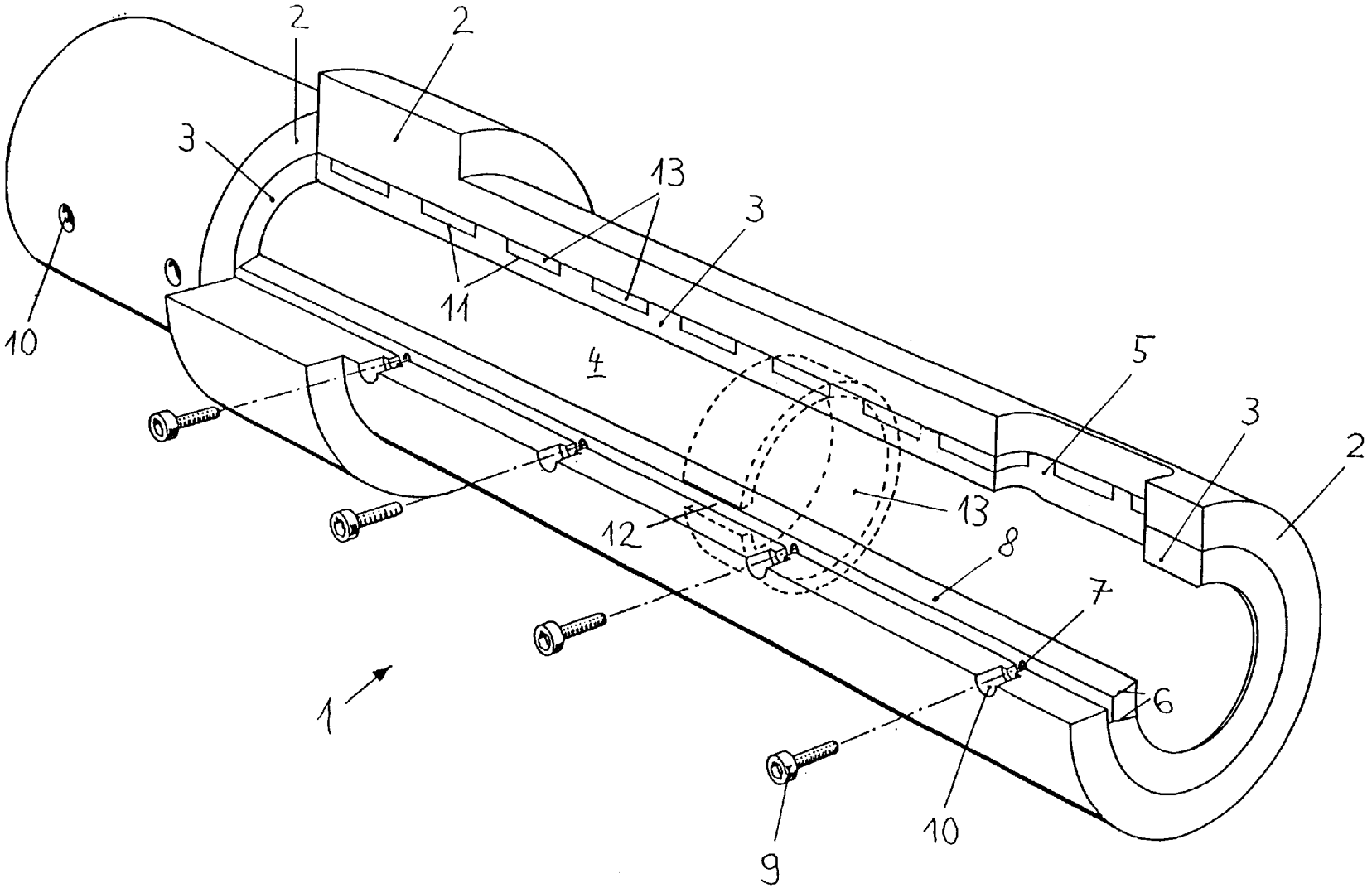
2
3
5
6
7
8
10
9
13
3
13
4
12
11
2
2
3
10
1

CASTING CHAMBER FOR A DIE CASTING MACHINE

The present invention relates to a casting chamber for a die casting machine, of which the cylindrical inner surface constitutes a sliding surface for a pressure piston, with a feed opening for molten casting material.

Such casting chambers are known and include an oil or water-cooling apparatus by which excessive heat, introduced along with the molten casting material, can be led away and the casting chamber can be maintained at a constant working temperature, so that heat-deformation of the casting chamber remains as small as possible. Further, in the OL DE 44 21 598 a casting chamber has been described in which a half shell providing the feed opening is interchangeably mounted on the casting machine for various uses of the casting machine. In another example embodiment, the region of the casting chamber directly opposite the feed opening, where the greatest wear occurs, has an exchangeable ceramic insert.

The object of the invention is to provide a casting chamber which does not require an oil or water cooled apparatus, without increasing the danger of heat deformation. Further, in the event of wear occurring on the sliding surface for the pressure piston, it is not necessary to replace the entire casting chamber. Further there is the possibility of casting with higher casting chamber temperatures.

In accordance with the invention, the stated object is attained, with a casting chamber of the kind described above, by installing in the casting chamber jacket along its entire length or a part of the length, an interchangeable inner jacket which provides the sliding surface for the pressure piston, the inner jacket being pressed against the casting chamber jacket by means of a pressure apparatus. Where the inner jacket extends over the entire length, the heat distribution is uniform over the entire length. However it is possible that an inner jacket extending over only a part of the length would suffice. By means of the pressure apparatus there is attained a good contact between the inner jacket and the steel casting chamber jacket, so that heat in the latter can be further conducted away.

BRIEF DESCRITPION OF THE DRAWINGS

The FIGURE shows a perspective view of the casting chamber wherein, to improve the view, part of the chamber which is connected to the casting chamber end cover has been removed.

Advantageously, the pressure apparatus includes a conical wedge and screws, wherein the conical wedge is inserted in a conical slot and is drawn toward the casting chamber jacket by screws threadably engaging the wedge, whereby the inner jacket is also pressed against the casting chamber jacket. It is however also conceivable to structure the pressure device as a shrinkage apparatus, such that the exchangeability of the inner jacket by means of loosening the screws threadably engaged with the wedge becomes substantially simpler. In order to distribute the heat uniformly over the inner jacket periphery, it includes grooves, each containing a ring having a conical slot, the rings being of copper, copper alloy or any other highly heat conductive material. If the inner jacket is made of hot forged steel, it will work together with the inserted rings to achieve uniform heat distribution over the length and periphery. In the case where the piston slide surface is defined by a ceramic layer, the escape of heat to the outside can be reduced. If the inner jacket consists of a high temperature special alloy with a large nickel content, it is advantageous to apply an insulating layer to the outer periphery, so that, because the heat conductivity is significantly higher than with steel, casting can take place at higher casting chamber temperatures. In order to keep the piston sliding surface unitary, the conical wedge is advantageously made of the same material as the inner jacket.

In what follows, an example embodiment of a casting chamber in accordance with the invention will be described with reference to the single drawing FIGURE. The FIGURE shows a perspective view of the casting chamber wherein, to improve the view, part of the chamber which is connected to the casting chamber end cover has been removed. By contrast, in the chamber portion which is connected to the mold cover, the view has not been altered.

The casting chamber 1 consists of a cylindrical casting chamber jacket 2 made from steel, in which is installed an inner jacket 3 made from hot forged steel, of which the cylindrical inner surface constitutes a sliding surface 4 for the pressure piston. The casting chamber jacket 2 and the inner jacket 3 define a feed opening 5 for molten casting material. The inner jacket 3 is provided with a conical slot 6 in which is positioned a conical wedge 8, the latter having six threaded bores 7. Six hollow screws 9 are countersunk in corresponding bores 10 of the casting chamber 2, and are screwed into the threaded bores 7, such that the conical wedge 8, and consequently also the inner jacket 3, are pressed against the casting chamber jacket 2. The inner jacket 3 has, over its length, uniformly distributed spaced-apart grooves or circumferential chambers 11 in each of which is installed a ring 13 having a conical slot 12 to receive the conical wedge 8, the rings 13 being of copper, copper alloy, or another material with a high heat conductivity, for example hard solder.

Although preferred embodiments of the invention have been described herein in detail, it will be understood by those skilled in the art that variations may be made thereto without departing the spirit of the invention or the scope of the appended claims.

I claim:

1. A casting sleeve for a die casting machine, of which the cylindrical inner surface serves as a sliding surface for a pressure piston, with a feed opening for molten casting material, characterized in that, within the casting sleeve jacket, over its entire length or part of the length, an inner jacket, providing the sliding surface for the pressure piston, is exchangeably installed, the inner jacket having a slot along its length and a pressure apparatus inserted in said slot to press outer surfaces of said inner jacket, said pressure apparatus including a conical wedge and screws, wherein the conical wedge is installed in a conical slot of the inner jacket, and is pressed along with the inner jacket against the casting sleeve jacket by the screws threadedly engaging its threaded bores.

2. A casting sleeve according to claim 1, characterized in that the inner jacket is provided with grooves, in each of which is provided a ring defining a conical slot, the rings being of copper, copper alloy or some other material with high heat conductivity.

3. A casting sleeve according to claim 2, characterized in that the inner jacket consists of hot forged steel.

4. A casting sleeve according to claim 3, characterized in that a ceramic layer is provided as a slide surface for the pressure piston in the inner jacket.

5. A casting sleeve according to claim 2, characterized in that the inner jacket consists of a highly heat resistant special alloy with a high nickel content.

6. A casting sleeve according to claim 5, characterized in that the conical wedge is of the same material as the inner jacket.

* * * * *